United States Patent [19]

Sawyer

[11] Patent Number: 4,999,899

[45] Date of Patent: Mar. 19, 1991

[54] U-NUT REMOVAL TOOL

[75] Inventor: Gardner R. Sawyer, Holt, Fla.

[73] Assignee: Lisle Corporation, Clarinda, Iowa

[21] Appl. No.: 419,677

[22] Filed: Oct. 11, 1989

[51] Int. Cl.[5] ..... B25B 7/02

[52] U.S. Cl. ..... 29/243.56; 29/278

[58] Field of Search ..... 29/243.56, 267, 270, 29/278; 81/420; 254/28

[56] References Cited

U.S. PATENT DOCUMENTS

| | | | |
|---|---|---|---|
| 3,713,200 | 1/1973 | Burns | 29/267 |
| 4,096,618 | 6/1978 | Perline et al. | 29/278 |
| 4,597,148 | 7/1986 | Kennedy | 29/270 |
| 4,872,251 | 10/1989 | Sheppard | 29/243.56 |

*Primary Examiner*—Robert C. Watson

*Attorney, Agent, or Firm*—Allegretti & Witcoff, Ltd.

[57] ABSTRACT

The present invention relates to a tool for removing U-nuts fastened to a fastening member. A typical U-nut is comprised of a U-shaped spring clip having a projection that engages a detent formed in the fastening member and locks the U-nut in position. The tool is comprised of a blade, an extending member, a shank, and a handle. The blade is coupled to one end of the extending member and both are preferably formed of a unitary elongated member. The opposing end of the extension member is coupled to the handle by the shank. In operation the blade of the tool is used to disengage the projection from the detent formed in the fastening member thereby allowing the U-nut to be removed from the fastening member.

8 Claims, 2 Drawing Sheets

Fig.6
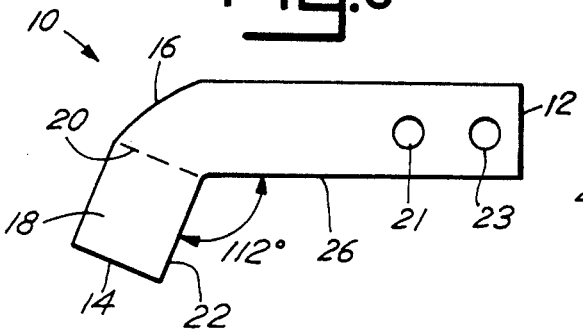
Fig. 7
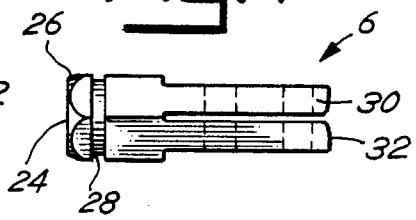
Fig.8
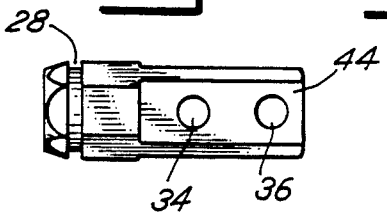
Fig.9
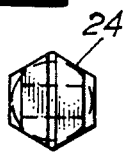
Fig.10
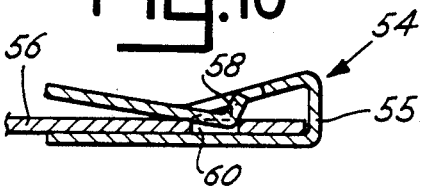
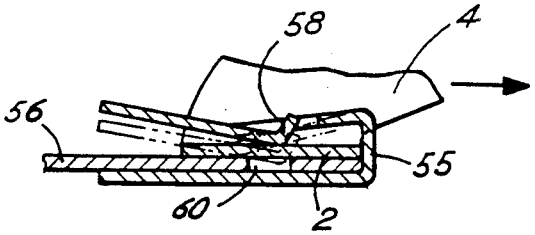
Fig.11

U-NUT REMOVAL TOOL

BACKGROUND OF THE INVENTION

The present invention relates to a tool for removing U-nuts fastened to a fastening member.

U-nuts are widely used in the automotive and other industries for mounting modules, door panels, hinges and other equipment and accessories. U-nuts are generally comprised of a U-shaped spring clip having a flexible projection which engages a detent formed in a fastening member. The U-shaped spring clip typically includes a nut mounted thereon for receiving a threaded screw or other fastening implement thereby providing a mount on which the above equipment and accessories may be mounted. Although U-nuts are easily fastened to the fastening member by sliding the U-shaped clip onto the fastening member until the flexible projection engages the detent and locks the U-nut in position, removal of the U-nut is not as simple. Generally, the U-nut may only be removed by disengaging the flexible projection from the detent and sliding the U-nut off of the fastening member. In the past there have been no tools specifically designed for disengaging the flexible projection from the detent and removing the U-nut from the fastening member.

Therefore, the present invention overcomes the problem of removing a U-nut by providing a tool for disengaging the flexible projection from the detent and sliding the U-nut off of the fastening member.

SUMMARY OF THE INVENTION

Briefly, the present invention relates to a tool for removing a U-nut fastened to a fastening member. A typical U-nut is comprised of a U-shaped spring clip having a flexible projection that engages a detent formed in the fastening member and locks the U-nut in position. The U-nut removal tool is comprised of a blade, an extending member, a shank, and a handle. The blade is formed on one end of the extending member, both of which are preferably formed of a unitary elongated member. The other end of the extending member is coupled to the handle by the shank. In operation the blade of the tool is used to disengage the flexible projection from the detent formed in the fastening member thereby allowing removal of the U-nut.

Thus, it is an object of the present invention to provide a tool for disengaging the flexible projection of a U-nut and removing the U-nut from a fastening member.

Another object of the present invention is to provide a U-Nut Removal Tool comprised of a blade and extension member formed of a unitary extension member.

Another object of the present invention is to provide a U-nut removal tool that is durable.

A further object of the present invention is to provide a U-nut removal tool that is comprised of a minimum number of components.

A still further object of the present invention is to provide a U-nut removal tool that is economical to manufacture.

These and other objects, advantages and features of the present invention will be set forth in the Detailed Description of the Preferred Embodiment which follows.

BRIEF DESCRIPTION OF THE DRAWINGS

In the Detailed Description of the Preferred Embodiment, reference will be made to the following figures wherein like numerals indicate like elements.

FIG. 6 is a side elevation view of a unitary elongated member used to form a blade and extending member portions of the preferred embodiment of the present invention.

FIG. 7 is a top elevation view of a shank portion of the preferred embodiment of the present invention.

FIG. 8 is a side elevation view of the shank as used in the preferred embodiment of the present invention.

FIG. 9 is an end elevation view of the shank portion of the preferred embodiment.

FIG. 10 is a side elevation sectional view of a U-nut illustrating a flexible projection of a U-nut engaged in a detent of a fastening member.

FIG. 11 is a partial side elevation view of the preferred embodiment of the present invention taken along the lines 10—10 of FIG. 1.

DETAILED DESCRIPTION OF THE PREFERRED EMBODIMENT

Figure 1:
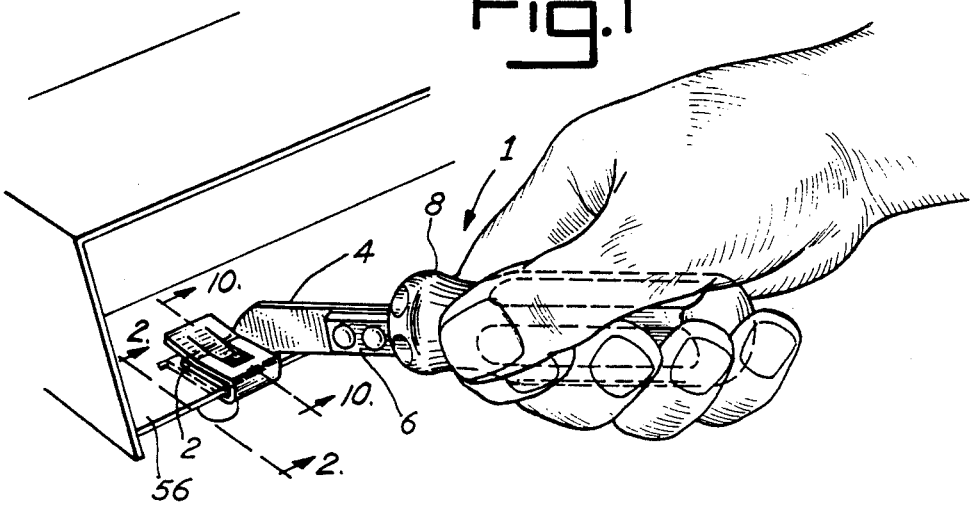
FIG. 1 is a perspective view of the preferred embodiment of the present invention.

Referring now to FIG. 1, the U-nut removal tool 1 of the present invention generally includes a blade 2, an extending member 4, a shank 6, and a handle 8.

Referring now to FIG. 6, the blade 2 and extending member 4 as shown in FIG. 1 are shown to be comprised of a single unitary elongated member 10 having a first end 12, a second end 14 and a dogleg bend 16 near the second end 14. The dogleg bend 16 forms an angle of approximately 112 degrees between the first and second ends 12 and 14. The blade 2 is formed by folding a substantially square portion 18 of the elongated member 10 near the second end 14 along a base 20 of the dogleg bend 16 such that the plane of the blade 2 is normal to the plane of the extending member 4 as shown in FIG. 1. The unitary elongated member 10 also includes two mounting holes 21 and 23 located near the first end 12. The unitary elongated member 10 and the holes 21 and 23 therethrough are preferrably formed by a stamping process thereby increasing the efficiency of manufacture of the blade 2 and extending member 4.

Figure 2:
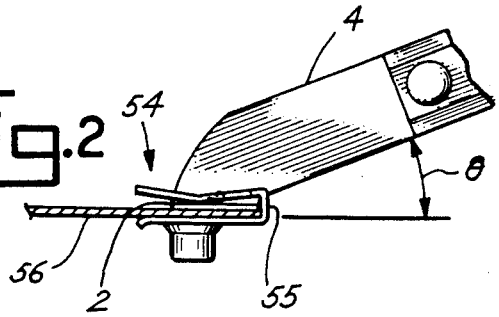
FIG. 2 is a partial side elevation view of the preferred embodiment taken along lines 2—2 of FIG. 1.
Figure 3:
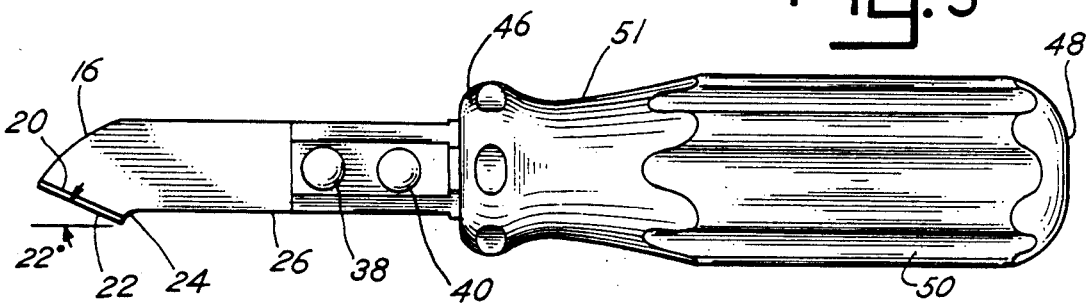
FIG. 3 is a side elevation view of the preferred embodiment of the present invention.
Figure 4:
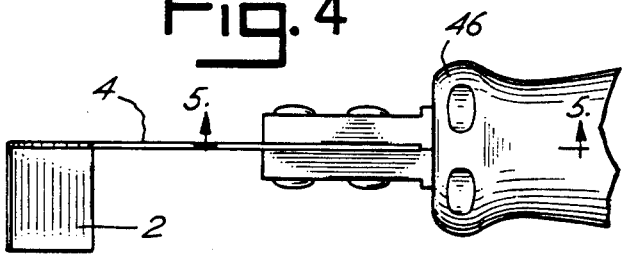
FIG. 4 is a partial top elevation view of the preferred embodiment of the present invention.
Figure 5:
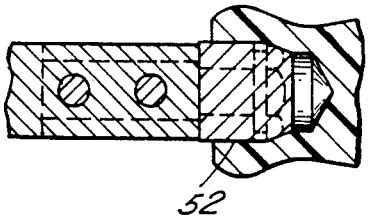
FIG. 5 is a partial sectional view of the preferred embodiment taken along lines 5—5 of FIG. 4.

Referring now to FIGS. 1, 2 and 3, the base 20 of dogleg bend 16 is located such that the base portion 22 of blade 2 extends below the base portion 26 of the extending member 4, and the relative angle between the base portion 22 and the base portion 26 is approximately 22 degrees. The relative angle between the base portion 22 and the base portion 26 orients the handle 8 and the extending member 4 at an angle, relative to a fastening member 56 thereby providing leverage to the U-nut removal tool 1 while engaged with a U-nut 54.

The unitary elongated member 10 is preferably comprised of stainless steel, although other rigid materials such as aluminum, metal alloys or composites may be employed.

Alternatively, the blade 2 may be coupled to a shaft or other component and need not be integrally formed from a unitary piece of material.

The blade 2 has a square area of approximately 0.49 square inches. The extending member 4 has a length of approximately 2.80 inches and a width of approximately 0.62 inches. Both the blade and the extending member have a thickness of approximately 0.042 inches.

Referring now to FIGS. 6, 7, 8 and 9, the shank 6 is shown to include a first end 24 defined by a hexagonal shaped cross section. The first end 24 has a bevelled edge 26 and an annular groove 28. The shank 6 also includes a second end defined by parallel members 30 and 32. The parallel members 30 and 32 define a space therebetween for receiving the first end 12 of the elongated member 10 and include transverse holes 34 and 36 that correspond to the location of the holes 21 and 23 in the elongated member 10. The elongated member 10 is secured to the shank 6 by a pair of rivets 38 and 40 that pass through holes 21, 23, 34, and 36 as shown in FIG. 3.

The shank 6 is preferably comprised of aluminum, although other rigid materials such as those exemplified above may be employed.

The overall length of the shank is approximately 1.75 inches. The first end of the shank 24 has a diameter of approximately 0.56 inches and the hexagonal portion has a length of approximately 0.65 inches. The remainder of the shank 6 comprises the parallel members 30 and 32. The parallel members have an overall width of approximately 0.44 inches and a height of approximately 0.62 inches.

Referring now to FIGS. 1–3, 5, 7, and 9 the handle 8 includes a first end 46 and a second end 48. The handle 8 includes a plurality of ribs 50 and a contoured neck 51 for providing an anti-slip gripping surface. The first end 46 includes a hole 52 for receiving the first end 24 of the shank 6. The diameter of the hole 52 is slightly smaller than the diameter of the first end 24 of the shank 6. The bevelled edge 26 of the shank 6 facilitates inserting the shank 6 into the hole 52. The handle 8 is comprised of a plastic material and the elasticity of the material binds the hexagonal shape of the first end 24 and the annular groove 28 of the shank 6 when the shank 6 is inserted into the hole 52 thereby securely coupling the shank 6 to the handle 8.

The handle is preferably comprised of a clear cellulose acetate material.

Referring now to FIGS. 1, 2, 10 and 11, the U-nut removal tool 1 may be employed to remove the U-nut 54 fastened to the fastening member 56. The U-nut 54 includes a U-shaped spring clip 55 and a flexible projecting member 58 for engaging a detent 60 formed in the fastening member 56 and locking the U-nut 54 in position on the fastening member. The blade 2 of the U-nut remover 1 is inserted between the flexible projecting member 58 of U-nut 54 and fastening surface 56 thereby releasing projecting member 58 from detent 60 and allowing removal of the U-nut 5 from the fastening surface 56 as illustrated in FIG. 11.

While there has been set forth a preferred embodiment of the present invention, it is to be understood that the invention is to be limited only by the scope of the following claims and their equivalents.

What is claimed is:

1. A tool for removing a U-nut fastened to a fastening member, said U-nut being of the type including a U-shaped spring clip having a flexible projecting member wherein said projecting member engages a detent formed in said fastening member thereby fastening said U-nut to said fastening member, said tool comprising, in combination:

a handle having a first end and a second end; and an actuating member mounted to said first end of said handle, said actuating member having a flat planer shape defining an extending member and a flat blade extending at a 90 degree angle thereto, said actuating member formed of a unitary plane member, said extending member including a first end mounted to the first end of the handle and also including a second end with a dog leg bend proximate thereto and with the flat blade being mounted thereto, said flat blade being formed by folding a substantially square portion at said second end along the base of the dog leg, whereby said actuating member may be inserted between said fastening member and said U-nut thereby disengaging said projections engaged in said detent and allowing said U-nut to be removed from said fastening member.

2. A tool for removing U-nuts as claimed in claim 1 wherein said handle member is plastic.

3. A tool for removing U-nuts as claimed in claim 1 wherein said handle member includes a plurality of ribs.

4. A tool for removing U-nuts as claimed in claim 1, wherein said actuating member includes a shank having a first end and a second end, said first end of said shank being coupled to said first end of said handle and said second end of said shank being coupled to said first end of said extending member.

5. A tool for removing U-nuts as claimed in claim 1 wherein said extending member and said blade are steel.

6. A tool for removing U-nuts as claimed in claim 4 wherein said first end of said shank has a polygonal cross section, said first end of said shank being securely received in a hole bored in said handle, and said second end of said shank includes two parallel members having a space therebetween for receiving said second end of said extending member, said second end of said extending member being secured between said parallel members by a plurality of rivets through said parallel members of said shank and said second end of said extending member.

7. A tool for removing U-nuts as claimed in claim 4 wherein said shank is aluminum.

8. A tool for removing a U-nut fastened to a fastening member, said U-nut being of the type including a U-shaped spring clip having a flexible projecting member wherein said projecting member engages a detent formed in said fastening member thereby fastening said U-nut to said fastening member, said tool comprising, in combination:

a handle having a first end and a second end; and an actuating member mounted to said first end of said handle, said actuating member having a flat planer shape defining an extending member having a first end and a second end and a flat blade extending in a plane at an angle with respect to the axis through said first and second ends of said extending member, whereby said actuating member may be inserted between said fastening member and said U-nut thereby disengaging said projection engaged in said detent and allowing said U-nut to be removed from said fastening member;

said actuating member including a shank having a first end and a second end, said first end of said shank being coupled to said first end of said handle and said second end of said shank being coupled to said first end of said extending member;

said first end of said shank having a polygonal cross section, said first end of said shank being securely received in a hole bored in said handle, and said second end of said shank including two parallel members having a space there between for receiving said second end of said extending member, said second end of said extending member being secured between said parallel members by a plurality of rivets through said parallel members of said shank and said second end of said extending member.

* * * * *